United States Patent [19]

Inoue et al.

[11] Patent Number: 4,695,333

[45] Date of Patent: Sep. 22, 1987

[54] IRON-CHROMIUM-BASE SPINODAL DECOMPOSITION-TYPE MAGNETIC (HARD OR SEMI-HARD) ALLOY

[75] Inventors: Kiyoshi Inoue; Hideo Kaneko, both of Tokyo, Japan

[73] Assignee: Inoue-Japax Research Incorporated, Kanagawaken, Japan

[21] Appl. No.: 946,106

[22] Filed: Dec. 22, 1986

Related U.S. Application Data

[63] Continuation of Ser. No. 304,931, Sep. 23, 1981, abandoned.

[30] Foreign Application Priority Data

Sep. 29, 1980 [JP] Japan ..... 55-136009

[51] Int. Cl.[4] ..... H01F 1/04

[52] U.S. Cl. ..... 148/306; 148/315; 148/422; 148/423; 420/583; 420/70; 420/104; 420/127

[58] Field of Search ..... 148/315, 306, 422, 423; 420/583, 584, 585, 586, 34, 70, 104, 127

[56] References Cited

U.S. PATENT DOCUMENTS

| | | | |
|---|---|---|---|
| 3,806,336 | 4/1974 | Kaneko et al. | 420/583 |
| 3,954,519 | 5/1976 | Inoue | 148/31.57 |
| 4,171,978 | 10/1979 | Inoue | 148/31.57 |
| 4,236,919 | 12/1980 | Kamino | 148/31.57 |
| 4,324,597 | 4/1982 | Kamino et al. | 148/31.57 |

FOREIGN PATENT DOCUMENTS 404890 10/1973 U.S.S.R. .

*Primary Examiner*—John P. Sheehan

*Attorney, Agent, or Firm*—Karl F. Ross; Herbert Dubno

[57] ABSTRACT

A spinodal decomposition type ternary magnetic allioy is provided which contains, by weight, 3 to 40% vanadium, 5 to 45% chromium and the balance essentially iron. Optionally the alloy may contain at least one additional element, said additional element being present individually in an amount of 0.1 to 5% by weight and not greater than the amount of either vanadium or chromium. The alloy is easy to work and has excellent hard or semi-hard magnetic properties comparable with those of conventional iron-chromium-cobalt alloys. Yet the alloy is low in material cost and simple and inexpensive to manufacture.

9 Claims, 8 Drawing Figures

FIG. 3
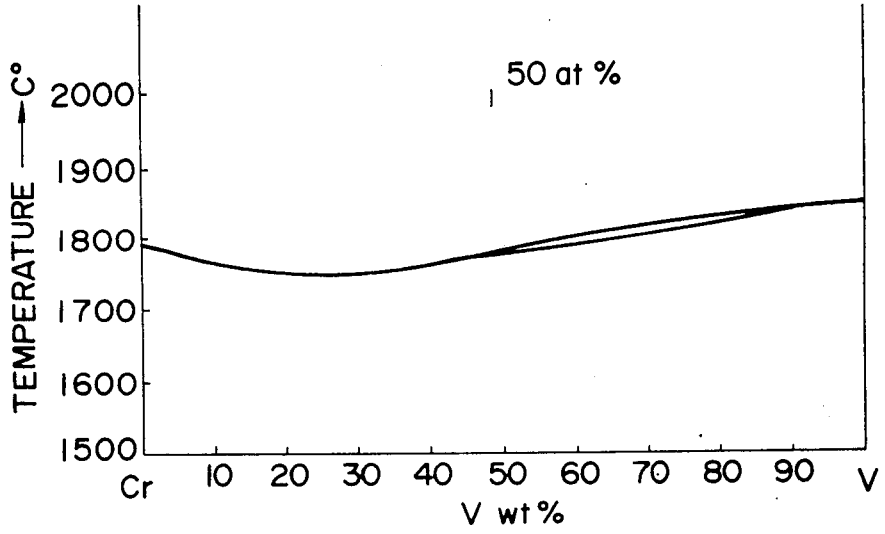
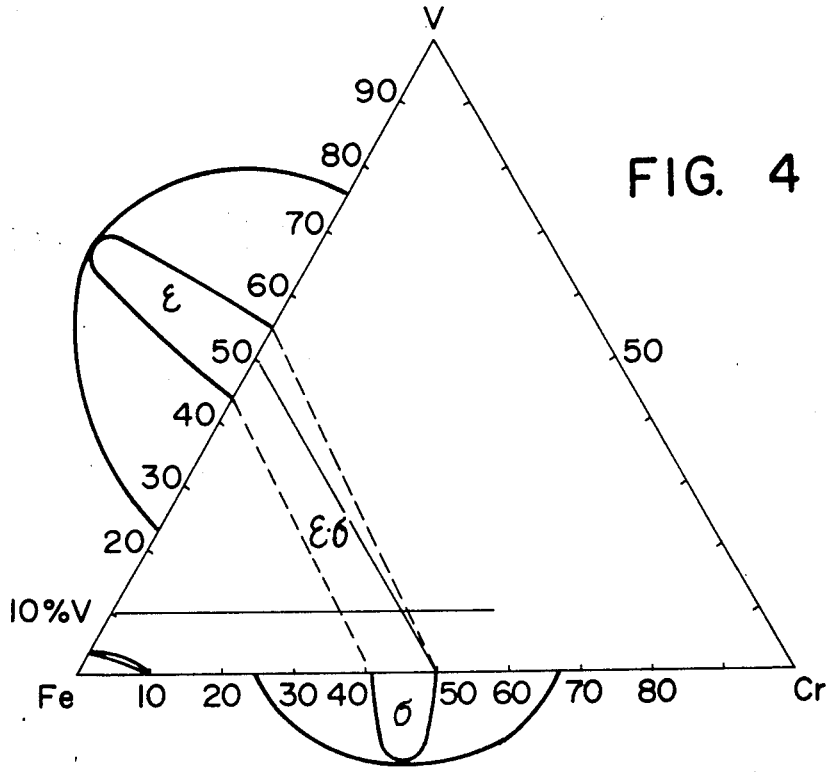
FIG. 4

IRON-CHROMIUM-BASE SPINODAL DECOMPOSITION-TYPE MAGNETIC (HARD OR SEMI-HARD) ALLOY

This is a continuation of application Ser. No. 304,931, filed on Sept. 23, 1981, now abandoned.

FIELD OF THE INVENTION

This invention relates to an iron/chromiun base spinodal decomposition-type magnetic (hard or semi-hard) alloy and, more particularly, to a novel and useful magnetic alloy of the type described as well as a method of making same.

BACKGROUND OF THE INVENTION

As pointed out in our U.S. Pat. No. 3,806,336 issued Apr. 23, 1974, it is known that the iron/chromium alloy system has, in its composition diagram, a "limit of metastability" or "spinodal" which is thermodynamically defined as the locus of disappearance of the second derivative of the Helmholtz free energy with respect to the composition of the system. When a high-temperature composition, which is of a homogeneous single-phase structure ($\alpha$-phase), of the alloy is brought within the spinodal in a lower temperature range, it is transformed into a separated two-phase structure ($\alpha_1+\alpha_2$), the phase separation being called "spinodal decomposition".

The decomposed alloy has a periodic microstructure generally of the order of hundreds of angstroms and which consists of two composition-modulated isomorphous phases in which one phase ($\alpha_1$) is in the form of an iron-rich fine precipitate uniformly distributed in the other phase ($\alpha_2$) which is chromium-rich and forms the matrix. Since in such a microstructure the first phase ($\alpha_1$) is magnetic or ferromagnetic and the second phase ($\alpha_2$) is nonmagnetic or paramagnetic, there results a single-domain structure whereby a highly retentive magnetic body can be obtained.

U.S. Pat. No. 3,806,336 has pointed out that the iron/-chromium alloy of spinodal decomposition type, when it contains cobalt, optionally also with one or both of molybdenum and tungsten in the proportions set forth therein, represents an improved magnetic-material system whose magnetic retentivity and magnetic energy product are comparable with or generally even higher than those of "Alnico" (iron/aluminum/nickel/cobalt) alloys which have hitherto been the mainstay of the magnetic industry. It has been taught that addition of silicon up to a certain proportion moderates heat-treatment conditions required to accomplish the spinodal decomposition of the alloys without materially decreasing the desirable magnetic properties attainable therewith. U.S. Pat. No. 3,954,519 issued May 4, 1976 discloses an improved iron-chromium base spinodal decomposition-type magnetic alloy which by weight consists of essentially 3 to 30% cobalt, 10 to 40% chromium, 0.2 to 5% one or both of niobium and tantalum, 0 to 5% aluminum and the balance iron. U.S. Pat. No. 4,171,978 issued Oct. 23, 1979 discloses another improved iron-chromium base spinodal decomposition-type magnetic alloy which by weight consists of essentially of 3 to 30% cobalt, 10 to 40% by weight chromium, 0.1 to 15% vanadium and the balance iron. The art has also recognized that these magnetic alloys may contain additions of one or more of manganese, nickel, copper, zirconium and aluminum in a small proportion.

In brief, all of the iron-chromium base spinodal decomposition type magnetic alloys referred to hereinbefore contains cobalt as one essential element of the ternary alloy system and it has commonly been believed that any such alloy to be practical must contain a substantial amount of cobalt as the essential third element to the iron-chromium binary alloy system. The recent instability of raw cobalt supply and distribution and the extreme rise of its price in recent years have, however, made these iron-chromium-cobalt magnetic alloys less than satisfactory and not as economical than originally expected.

OBJECTS OF THE INVENTION

It is an important object of the present invention to provide a novel iron-chromium base ternary magnetic alloy which does not contain cobalt as its third component but which has good workability and excellent hard or semi-hard magnetic properties comparable with those of iron-chromium-cobalt alloys and is yet relatively low in material cost and simple and inexpensive to manufacture.

Another object of the invention is to provide a method of the manufacture of the novel magnetic alloy.

SUMMARY OF THE INVENTION

In accordance with the present invention there is provided an iron-chromium base spinodal decomposition-type ternary magnetic alloy which consists by weight of 3 to 40% vanadium, 5 to 45% chromium, and the balance essentially iron. Preferably the alloy contains vanadium in an amount not less than 5% by weight and not greater than 25% by weight. The alloy contains chromium in an amount preferably not less than 10% by weight and not greater than 35% by weight. The amount of iron should be at least 40% by weight and should preferably be at least 50% by weight.

The ternary Fe-Cr-V alloy according to the present invention may contain 0.1 to 8% by weight of at least one additional element selected from the group which consists of titanium, manganese, cobalt, nickel, silicon, niobium, tantalum, molybdenum, zirconium, tungsten, germanium, aluminum, copper, scandium, yttrium and rare-earth elements. Any one such element when present in the alloy should be present in an amount between 0.1 and 5% by weight and not greater than the amount of either vanadium or chromium. When more than one such elements are present, the lower limit of the added amount of the elements contained may be 0.2% by weight.

The invention provides an iron-chromium base spinodal decomposition-type magnetic alloy which consists by weight of 3 to 40%, preferably 5 to 25%, vanadium; 5 to 45%, preferably 10 to 35%, chromium; 0.1 to 8% at least one of additional elements selected from the group which consists of titanium, manganese, cobalt, nickel, silicon, niobium, tantalum, molybdenum, zirconium, tungsten, aluminum, copper, yttrium, scandium and rare-earth elements; and the balance not less than 40%, preferably not less than 50%, iron, wherein each of the said additional elements is contained in an amount between 0.1 and 5% by weight and not greater than the amount of either vanadium or chromium. When more than one such additional elements are contained, the lower limit of the added amount of the elements contained may be 0.2% by weight.

In accordance with a further aspect of the present invention there is provided a method of manufacturing a hard or semi-hard magnetic material, which method comprises the steps of: (a) forming a body of a spinodally decomposable alloy composition of iron-chromium base by casting an admixture of 3 to 40%, preferably 5 to 25%, by weight vanadium, 5 to 45%, preferably 10 to 35%, by weight chromium, 0 to 8%, when included, 0.1 to 8%, by weight at lease one of additional elements selected from the group which consists of titanium, manganese, cobalt, nickel, silicon, niobium, tantalum, molybdenum, zirconium, tungsten, germanium, aluminum, copper, yttrium, scandium and rare-earth elements and the balance not less that 40%, preferably not less than 50%, by weight iron, wherein each of the said additional elements when included is present in the mixture in an amount of 0.1 and 5% by weight and not greater than the amount of either vanadium or chromium; (b) solution-treating the said body at an elevated temperature, e.g. between 900° and 1200° C., and for a period sufficient to produce a homogeneous single $\alpha$-phase structure in the body; and aging the solution-treated body at a reduced temperature and for a time period sufficient to spinodally decompose therein the said single $\alpha$-phase structure into a composition-modulated phase-separated structure consisting of a ferromagnetic $\alpha_1$-phase and a paramagnetic $\alpha_2$-phase, the phase-separated structure forming a magnetic alloy.

The method may include, prior to step (b), a further step of disintegrating the said cast body into a powdery form and then compacting the disintegrated body into a coherent body.

The aging step (c) may be carried out in a plurality of steps or at a plurality of successively decreased temperatures, or alternatively continuously at a predetermined rate of cooling, say, 10° to 40° C./hour, down to a final aging temperature, say, 500° or 550° C.

The method preferably includes, prior to stepwise or continuous aging step, a thermomagnetic treatment where the alloy body subsequent to step (b) may be isothermally treated at an aging temperature between 700° and 900° C. under a magnetic field. It has been found that this procedure gives rise to a marked enhancement in permanent magnetic properties of the alloy body by imparting strong magnetic anisotropy thereto. The thermomagnetic treatment of the alloy body is carried out preferably upon locating a composition of the alloy body and a treatment temperature in an area defined with magnodal and Curie's temperature curve in a phase diagram of the alloy.

Furthermore, a cold-working or hot-working step may be introduced between the thermomagnetic treatment or the solution-treatment and the step or continuous aging step to enhance the permanent magnetic properties of the alloy body by mechanically imparting magnetic anisotropy thereto.

The invention also provides, in a further aspect thereof, a hard or semi-hard magnetic alloy consisting of a body formed by the casting of an admixture of 3 to 40%, preferably 5 to 25%, by weight vanadium, 5 to 45%, preferably 10 to 35%, by weight chromium, 0 to 8%, when included more than 0.1, by weight at least one of additional elements selected from the group which consists of titanium, manganese, cobalt, nickel, silicon, niobium, tantalum, molybdenum, zirconium, tungsten, germanium, aluminum, copper, yttrium, scandium and rare-earth elements and the balance not less than 40%, preferably not less than 50%, by weight iron wherein each of the said additional elements when included is present in the mixture in an amount of 0.1 and 5% by weight and not greater than the amount of either vanadium or chromium, the said body having a metallurgical structure consisting of an $\alpha_1$ phase which is ferromagnetic and an $\alpha_2$ phase which is paramagnetic, resulting by aging from the spinodal decomposition of a homogeneous single $\alpha$-phase structure developed by solution-treatment of the said cast body.

BRIEF DESCRIPTION OF THE DRAWING

These and other features of the present invention as well as advantages thereof will become more readily apparent from the following description taken with reference to accompanying drawing in which:

FIG. 3 is a phase diagram of vanadium-chromium binary alloy;

FIG. 4 is a triangular phase diagram of iron-chromium-vanadium ternary alloy;

SPECIFIC DESCRIPTION

Various iron-based binary alloy systems have been investigated. They include Fe-Ti, Fe-V, Fe-Co, Fe-Pt, Fe-Ge and Fe-W, and have been found to show various rates of change or differential coefficients of Curie's temperature in the temperature range between 700° and 800° C. with respect to composition ($d\theta/dc$ where $\theta$ is Curie's temperature and c is the concentration of the alloying element with iron) and that this occurrs in each binary system at a low proportion of the alloying element which lies in the ferromagnetic phase. Such a proportion and a rate of change are listed in Table 1 below.

TABLE 1

| Alloying Element | Rate of Change of Curie's Temp ($d\theta/dc$) in 700 to 800 °C. | Composition |
|---|---|---|
| Ti | 3.8 | 3-6% Ti—Fe |
| V | 11.2 | 5% V—Fe |
| Co | 13.2 | 5% Co—Fe |
| Pt | 1.9 | 9% Pt—Fe |
| Ge | 1.6 | 8% Ge—Fe |
| W | 2.8 | 6% W—Fe |

It is seen that the vanadium and cobalt binary alloys both have a rate of change of Curie's temperature with respect to the concentration of the alloying element in excess of 10. This has led to the assumption that vanadium is a promizing third element, in lieu of cobalt, which could be added to the iron-chromium binary system to form a new ternary alloy of spinodally decomposable composition.

Figure 1:
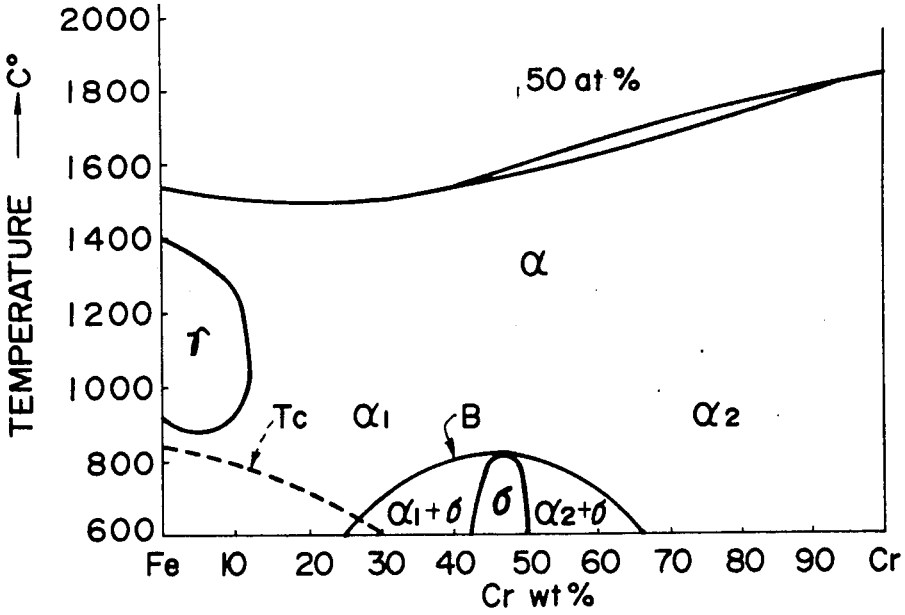
FIG. 1 is a phase diagram of iron-chromium binary alloy.
Figure 2:
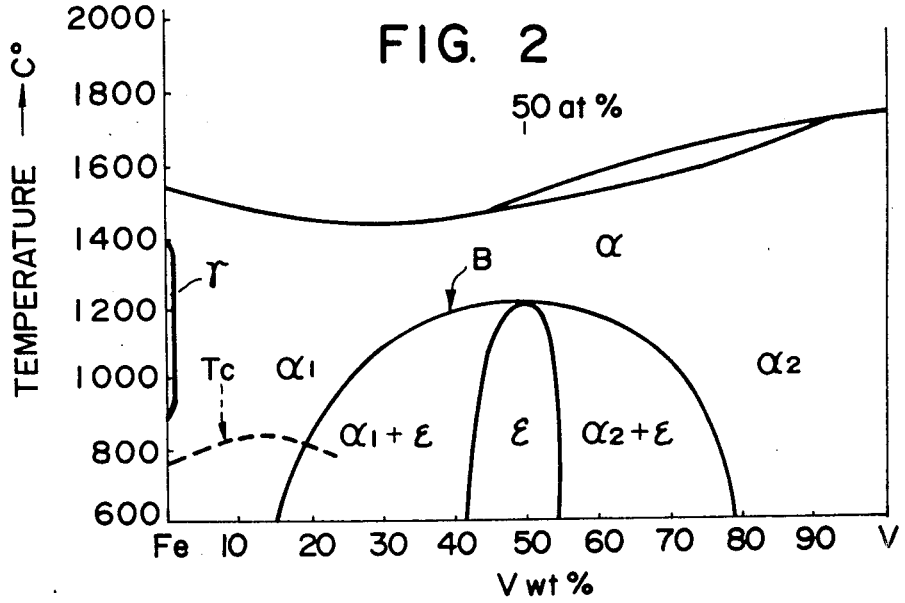
FIG. 2 is a phase diagram of iron-vanadium binary alloy.

Examination of the phase diagrams of iron-chromium (Fe-Cr) and iron-vanadium (Fe-V) binary alloy systems depicted in FIGS. 1 and 2 shows that these binary alloys are both of "closed $\gamma$" type—in which the harmful $\gamma$ phase is restricted—as distinguished from "open $\gamma$" type e.g., iron-cobalt binary alloy and each include the $\alpha$-phase extending continuously over the entire composition range. It is seen that both Fe-Cr and Fe-V systems possess a characteristic phase diagram in which an AB type compound is formed only within an $\alpha$-phase solid solution and yet in a localized area where the atomic ratio of the components is approximately 1:1 in a low temperature side shown defined by a quasi two-phase separation curve B called "binodal" Below this curve is the $\alpha$-phase solid solution separated into $\alpha_1$ which is iron-rich and ferromagnetic and $\alpha_2$ phase which is rich with the alloying element and paramagnetic. Specifically below this curve, Fe-Cr alloy produces precipitation of $\sigma$ phase (paramagnetic), $[\sigma+\alpha_1]$ phase and $[\sigma+\sigma_2]$ phase whereas Fe-V alloy produces precipitation of $\epsilon$ phase (paramagnetic), $[\epsilon+\alpha_1]$ phase and $[\epsilon+\alpha_2]$ phase. The chromium-vanadium (Cr-V) binary alloy is wholly of a solid solution as apparent from its phase diagram depicted in FIG. 3.

From FIGS. 1, 2 and 3 we can draw the phase diagram of ternary Fe-Cr-V alloy which is generally depicted in FIG. 4. It will be seen that an $\alpha$-phase solid solution extends continously over the entire composition range of the ternary Fe-Cr-V alloy at the high temperature side.

In the ternary system it will be seen that $\sigma$ phase and $\epsilon$ phase in the binary systems are combined to form a ternary compound $\epsilon.\sigma$ which constitutes a boundary for solid-solutioning. Thus, the $\alpha$ phase on the side of greater proportions of chromium and vanadium apart from this boundary can be predominantly $\alpha_2$ phase and hence paramagnetic whereas the $\alpha$ phase on the side of greater proportion of iron apart from this boundary can be predominantly $\alpha_1$ phase and hence ferromagnetic. In other words, the ternary alloy to be sufficiently magnetic should contain iron in excess of 40% by weight and preferably in excess of 50% by weight. This requirement is also supported from the fact that the binary curve levels down with increase in iron proportion to extend the $\alpha$ phase, enabling the solutioning temperature of the alloy to be reduced.

Figure 5:
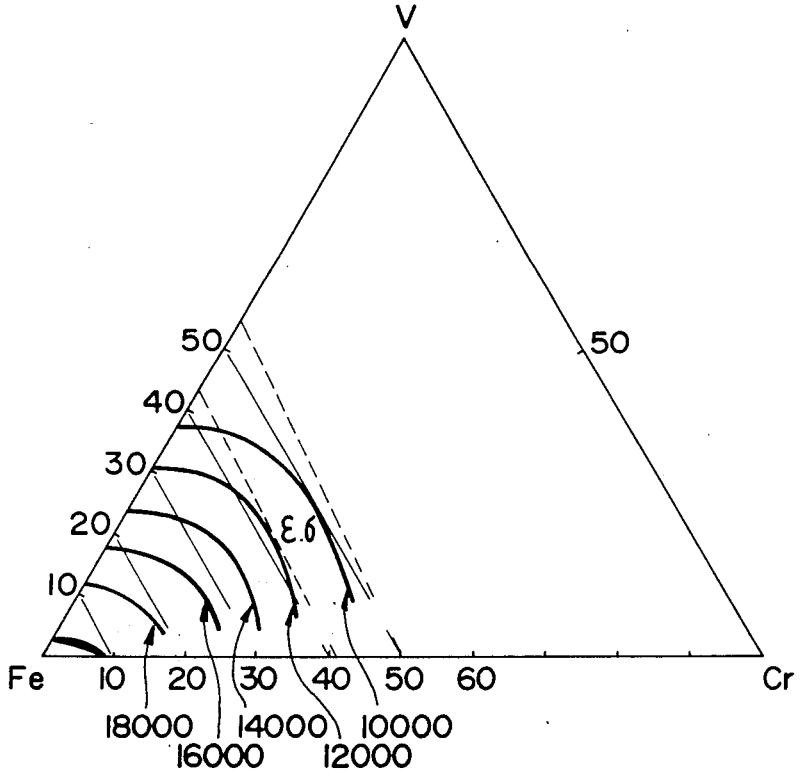
FIG. 5 is a triangular iron-chromium-vanadium alloy composition diagram plotting certain equi-valued saturation magnetization curves of the alloy system.

Relationship between Fe-Cr-V alloy composition and saturation magnetization has been investigated and is shown in the triangular composition diagram of FIG. 5. It is shown that saturation is at maximum with pure iron and decreases as the contents of chromium and vanadium increase. In order for saturation magnetization to be not less than 10,000 Gauss or $4\pi I_s \geqq 10{,}000$ G, chromium should be present in an amount not greater than 45% by weight and vanadium should be present in an amount not greater than 40% by weight. Preferably, the ternary alloy should contain chromium and vanadium in amounts not greater than 40% by weight and 35% by weight, respectively.

EXAMPLE I

Various proportions of Fe-Cr-V alloy were prepared by melting electrolytic iron, electrolytic chromium and commercially pure vanadium in a high-frequency induction furnace in the presence of an argon atmosphere and casting the melts to form specimens each in the form of a cylindrical rod having a diameter of 10 mm and a length of 20 mm. During melting, titanium is added at a proportion of 0.8% by weight to serve as a de-oxidizer. It was found that the specimens or ingots show excellent capability of cold and hot forming and were capable of being cold-swaged or cold-rolled at a rate of swaging or rolling approaching 90% (by which the cross-section is reduced). They were also capable of being hot-rolled or hot-swaged very well at any desired temperature in excess of 600° C.

Each of the specimens was subjected to solution-treatment which included heating at a temperature generally in excess of 1000° C. for a period of 1 hour and then quenching into water. This step of treatment could be dispensed with depending upon the manner of the preceding melting and casting step and will normally be required as a separate step where the melting step does ot take into account the size and shape of a product.

It has been found that the temperature for the solution-treatment may be reduced to almost 900° C. which is somewhat higher than the Curie's temperature line Tc (curve) found in each of FIGS. 1, 2 and 4 when the proportion of vanadium is relatively low. When a relatively high proportion of vanadium is used, the solutioning temperature needs to be raised to 1200° C. or more. With the amount of vanadium not greater than 20% by weight, the alloy can be solution-treated satisfactorily at a temperature of 1000° C. In general, the solutioning temperature should be higher than the Curie's temperature by more than 30° C. and preferably by more than 50° C.

Each of the specimens solution-treated was then aged or tempered in steps: first at a temperature of 750° C. for a period of 30 minutes, then at 700° C. for 30 minutes, next at 650° C. for 1 hour, then at 600° C. for 2 hours and finally at 550° C. for 3 hours.

Such typical four specimens as treated in the manner so far described had their compositions identified in Table 2 below and had their magnetic properties identified in Table 3 below.

TABLE 2

| | Composition (% by weight) | | |
|---|---|---|---|
| Specimen | V | Cr | Fe and impurities |
| No. 1 | 10 | 20 | balance |
| No. 2 | 7 | 13 | balance |
| No. 3 | 5.3 | 10 | balance |
| No. 4 | 3.8 | 7 | balance |

TABLE 3

| | Magnetic Properties | | |
|---|---|---|---|
| Specimen | Residual flux density Br (Gauss) | Coercive force Hc (Oersted) | Max. Energy Product (BH) max ($\times 10^6$ G.Oe) |
| No.1 | 14,000 | 320 | 3.3 |
| No. 2 | 14,400 | 180 | 2.1 |
| No. 3 | 15,000 | 90 | 1.8 |
| No. 4 | 15,400 | 70 | 1.5 |

Figure 6:
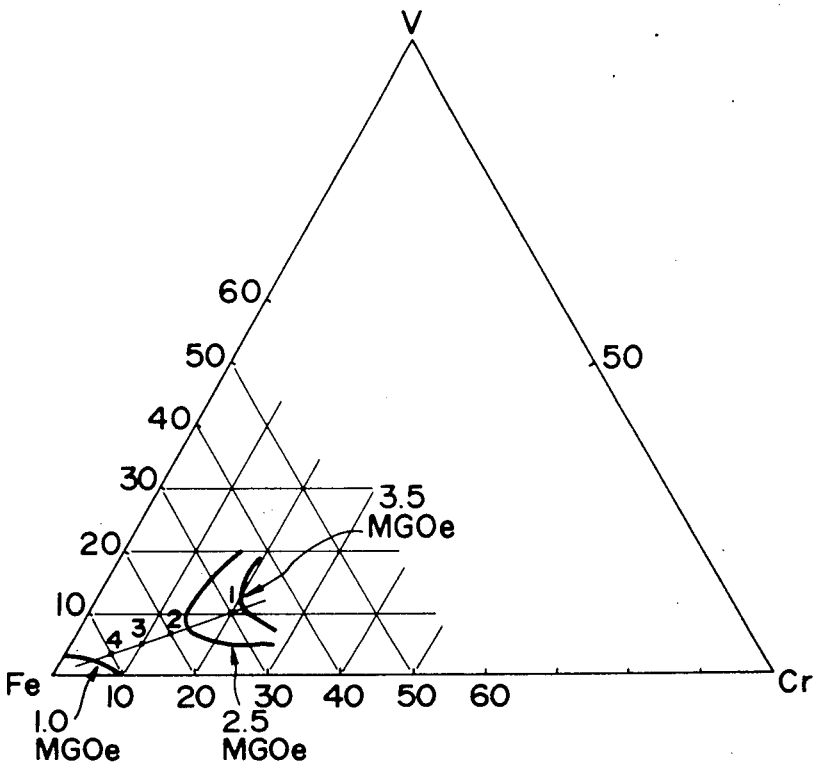
FIG. 6 is a triangular iron-chromium-vanadium alloy composition diagram plotting therein certain particular compositions and certain equi-valued maximum-energy-product curves.

In the diagram of FIG. 6, the compositions of these specimens are plotted together with three equi-valued maximum energy curves of 1.0 MGOe, 2.5 MGOe and 3.5 MGOe, respectively.

From the foregoing results, it is apparent that compositions with lesser V and Cr compositions offer high Br, low Hc and low (B.H)max properties and can effectively be used to form semi-hard magnets.

Substantially same magnetic properties as in Table 3 and FIG. 6 were obtained as well by employing, in lieu of the step aging described, a continuous aging process in which the alloy is cooled continuously at a rate of 10° to 40° C./hour.

It has been found that the Fe-Cr-V alloy according to the present invention can effectively be aged in a magnetic field or thermomagnetically treated, and/or cold-worked by, say, swaging to acquire magnetic anisotropy and thus to enhance its magnetic properties as a permanent or hard magnet.

Figure 7:
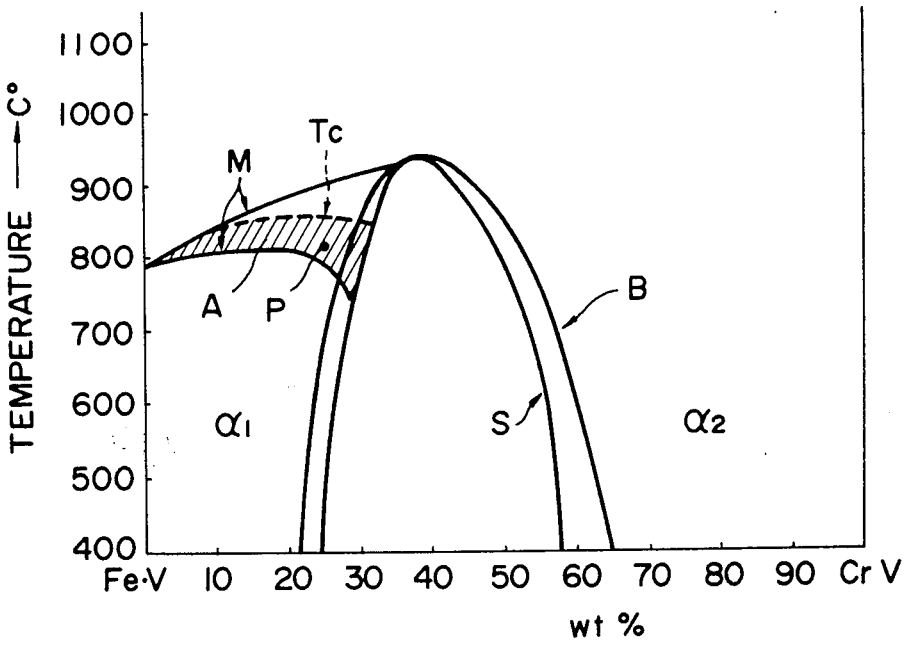
FIG. 7 is a cross-sectional phase diagram of the ternary iron-chromium-vanadium alloy according to the invention with the proportion of vanadium fixed at 10% by weight.

Referring to the effect of thermomagnetic treatment, there is shown in FIG. 7 a cross-sectional phase diagram of ternary Fe-Cr-V alloy according to the invention with the proportion of vanadium fixed at 10% by weight. This diagram includes a binodal curve B, a spinodal curve S inside the binodal curve and a horn-shaped magnodal curve M located in the ferromagnetic or $\alpha_1$ phase side of B and S and extending both high- and low-temperature sides of a Curie's temperature curve Tc. This indicates that the binodal and spinodal curves B and S in the region where they are crossed by the Curie's temperature curve Tc are, in effect, modified in a magnetic field to extend along the horn-shaped magnodal curve M and that a composition which lies in the area A shown by hatching can effectively be thermomagnetically treated at a temperature within this area. For the definition of "magnodal" in connection with binodal, spinodal and Curie's temperature, reference is made to U.S. Pat. No. 4,273,595 issued June 16, 1981.

EXAMPLE II

An alloy composition P falling within the area A in the diagram of FIG. 7 contains by weight 10% vanadium, 22.5% chromium and the balance essentially iron. Cast ingots of the alloy were solution-treated at a temperature of 1,000° C. for a period of 1 hour as in Example I and were then thermomagnetically treated at various temperatures for a period of 20 minutes under a magnetic field of 2000 Oersteds. Thereafter the specimens were aged by bringing them from the thermomagnetic treatment temperature down to a temperature of 750° C., holding them at the latter temperature for a period of 20 minutes, then cooling them at a rate of 40° C./hour down to 550° C. and finally holding them at the latter temperature for a period of 3 hours.

Figure 8:
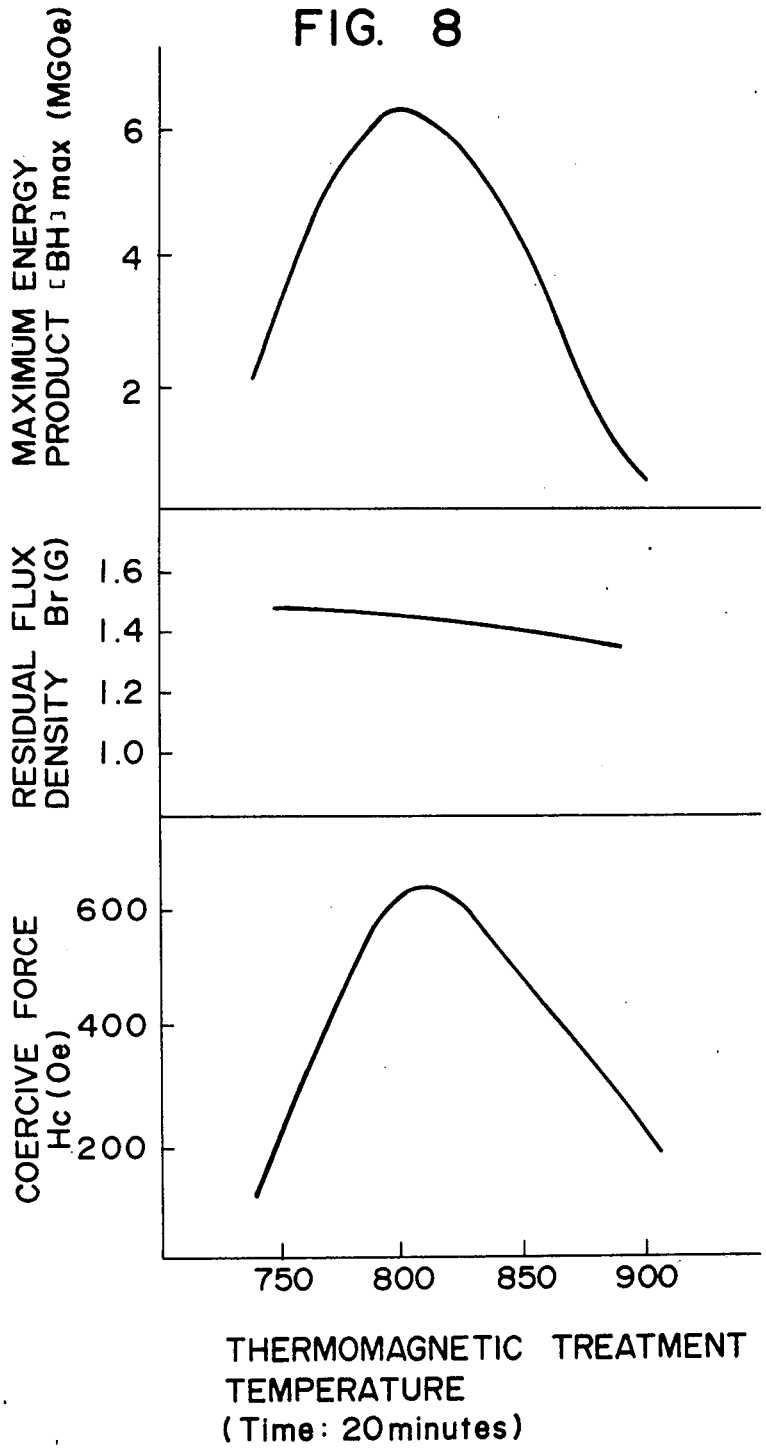
FIG. 8 is a set of graphs showing magnetic properties, i.e. maximum energy product, residual flux density and coercive force, respectively, of thermomagnetically treated ternary alloys according to the present invention.

In FIG. 8 there are shown graphically relationships between the thermomagnetic treatment temperature on one hand and the maximum energy product [BH]max in $10^6 \times$G.Oe, the residual flux density Br in Gauss and the coercive force Hc in Oersted on the other hand, respectively, of the specimens treated in the manner described. From the graphs of FIG. 8, it is seen that when the thermomagnetic treatment temperature ranges between 780° and 830° C., best results are obtained with the coercive force Hc and the magnetic energy product [BH]max reaching more than 600 Oersteds and 6 MGOe, respectively.

Cold-working, e.g. rolling or drawing at a room or moderate temperature, may also be employed advantageously to enhance permanent magnetic performance of the alloy of the invention. Thus, for example, the alloy body subsequent to the thermomagnetic treatment at 750° C. held for 20 minutes may be cold-worked while or after cooling by water or any other coolant and may then after heating at 750° C. for 30 minutes be aged continuously or in steps as described hereinbefore. Cold-working may also be employed apart from thermomagnetic treatment and allows an increase in permanent magnetic performance of the alloy body by more than 50% when the body has a size of 10 mm diameter and is worked at a working rate, say, of 80% (by which the cross section is reduced).

From the foregoing it will be appreciated that a novel and improved magnetic alloy has been provided which has an excellent permanent or hard magnetic properties, i.e. a high coercive force, residual flux density and maximum energy product, and may also be used favorably to constitute a semi-hard magnet with a high saturation or residual flux density as well as a moderate coercive force and maximum energy product. The alloy should include at least 5% and preferably 10% by weight chromium to be suitable to generate a desired coercive force. The chromium content should not exceed 45% by weight and should preferably be at most 35% by weight so as not to excessively reduce the iron-rich ferromagnetic phase and thus not to cause an unfavorable drop in flux density and further not to deteriorate workability of the alloy and to permit the solution treatment to be performed at a relatively low temperature. The alloy should contain at least 3% and preferably 5% by weight vanadium to be necessary to generate an increased coercive force and to retain a desired flux density. The vanadium content should not exceed 40% by weight and should preferably be at most 25% by weight so as not to cause an unfavorable drop both in coercive force and flux density and as to eliminate the unfavorable $\epsilon$ phase and to retain good workability of the alloy and further to allow the alloy to be treated at relatively low temperatures.

It will be understood that in accordance with the present invention, there is provided a highly useful and effective magnetic alloy which is less expensive in material cost and offers an excellent magnetic performance and an excellent workability.

What is claimed is:

1. A hard or semihard magnet consisting of a spinodally decomposed iron-chromium base ternary alloy composition consisting of 3 to 40% by weight vanadium, 5 to 45% by weight chromium and the balance iron wherein said alloy composition contains iron in an amount of not less than 40% by weight.

2. The magnet defined in claim 1 wherein said composition contains iron in an amount not less than 50% by weight.

3. The magnet defined in claim 1 or claim 2 wherein said composition contains vanadium in an amount of 5 to 25% by weight.

4. The magnet defined in claim 1 or claim 2 wherein said composition contains vanadium in an amount not less than 5% by weight.

5. The magnet defined in claim 1 or claim 2 wherein said composition contains vanadium in an amount not greater than 25% by weight.

6. The magnet defined in claim 1 or claim 2 wherein said composition contains chromium in an amount of 10 to 40% by weight.

7. The magnet defined in claim 1 or claim 2 wherein said composition contains chromium in an amount not less than 10% by weight.

8. The magnet defined in claim 1 or claim 2 wherein said composition contains chromium in an amount not greater than 40% by weight.

9. The magnet defined in claim 1 or claim 2 where said composition contains vanadium in an amount between 5 and 25% by weight and chromium in an amount between 10 and 40% by weight.

* * * * *